United States Patent [19]

Simon

[11] 4,388,045

[45] Jun. 14, 1983

[54] APPARATUS AND METHOD FOR MIXING AND PUMPING FLUIDS

[75] Inventor: Wayne E. Simon, Evergreen, Colo.

[73] Assignee: Martin Marietta Corporation, New York, N.Y.

[21] Appl. No.: 898,961

[22] Filed: Apr. 21, 1978

Related U.S. Application Data

[63] Continuation of Ser. No. 653,931, Jan. 30, 1976, abandoned.

[51] Int. Cl.[3] ..... F04F 5/42

[52] U.S. Cl. ..... 417/54; 417/171; 417/198

[58] Field of Search ..... 417/76, 84, 54, 158, 417/171, 151, 167, 194, 196, 197, 198; 60/269; 239/403, 405, 406

[56] References Cited

U.S. PATENT DOCUMENTS

| | | | |
|---|---|---|---|
| 584,951 | 6/1897 | More, Jr. | 239/405 |
| 1,950,828 | 3/1934 | Thompson | 417/171 X |
| 2,135,962 | 11/1938 | Conery et al. | 417/76 X |
| 2,565,907 | 8/1951 | Bertin et al. | 417/171 |
| 3,099,965 | 8/1963 | Regenscheit | 417/171 X |
| 3,648,457 | 3/1972 | Bobo | 60/39.74 R |
| 3,667,221 | 6/1972 | Taylor | 60/39.74 R |
| 3,739,576 | 6/1973 | Chamberlain | 60/39.74 R |

FOREIGN PATENT DOCUMENTS

| | | | |
|---|---|---|---|
| 115862 | 5/1918 | United Kingdom | 417/171 |
| 500690 | 2/1939 | United Kingdom | 239/406 |

*Primary Examiner*—Edward K. Look

*Attorney, Agent, or Firm*—Yount & Tarolli

[57] ABSTRACT

A first fluid injected at high velocity into a chamber forms a tornado-like vortex advancing toward a smoothly curved narrow throat communicating with an outlet. A second fluid inlet located within the eye of the vortex has a second fluid which is pumped therethrough and mixed with the first fluid by action of the vortex.

2 Claims, 1 Drawing Figure

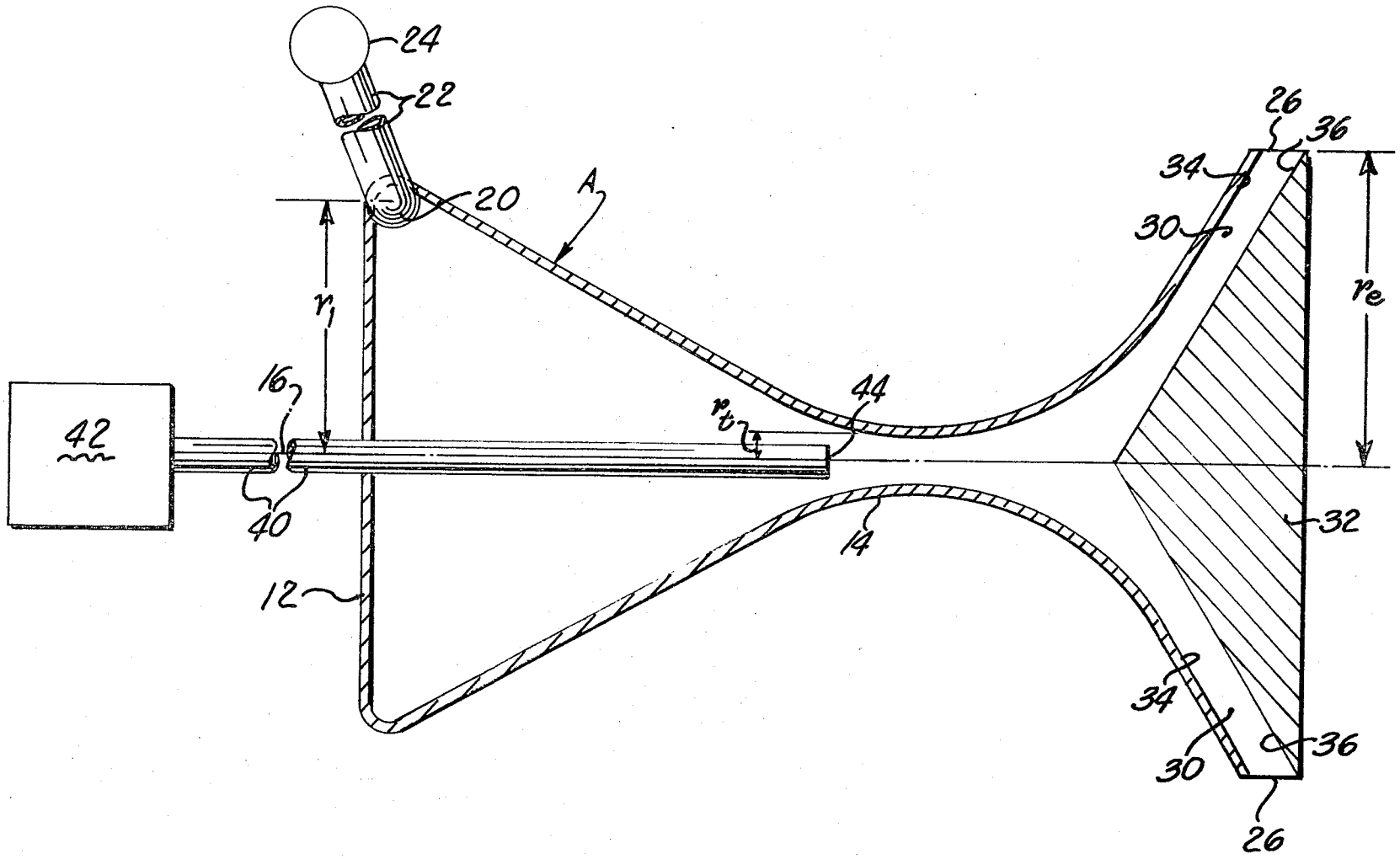
$r_e$
36
26
34
30
32
36
26
34
30
44
14
$r_b$
A
20
24
22
$r_1$
16
40
12
42

APPARATUS AND METHOD FOR MIXING AND PUMPING FLUIDS

This is a continuation, of application Ser. No. 653,931 filed Jan. 30, 1976.

BACKGROUND OF THE INVENTION

This application pertains to the art of mixing and pumping fluids and, more particularly, to mixing and pumping fluids with apparatus commonly known as an ejector.

Conventional ejectors are operated by injecting a first fluid at a high velocity longitudinally through a convergent-divergent nozzle having a throat where a second fluid inlet is located so that action of the first fluid pumps or draws the second fluid through the second fluid inlet. In such ejectors, the first and second fluids mix slowly because flow is essentially translational, and mixing takes place only in the translational shear layer between the two fluids. A long outlet passage (with large flow losses) is required between the throat and atmosphere to complete the mixing process and to convert high velocity back to pressure before the fluids are discharged to atmosphere.

Other known ejectors or apparatus for mixing and pumping fluids include those disclosed in U.S. Pat. No. 2,565,907, issued Aug. 28, 1951, to Bertin et al. The Bertin apparatus does not have a throat, and does not mix two fluids at a small radius and then discharge the mixed fluids at a larger radius. U.S. Pat. No. 3,306,525 issued Feb. 28, 1967, to Dornier discloses an apparatus wherein the flow radius of the first fluid is not controlled. Therefore, the exit radius of the first fluid is either the same as the inlet radius in FIGS. 2*a* and 2*b*, or slightly smaller than the inlet radius in FIG. 1. The swirling flow of the first fluid in Dornier is intended for mixing rather than pumping. In addition, the embodiment of FIG. 1 has essentially laminar flow where the two fluids are mixed. U.S. Pat. No. 3,739,576, issued June 19, 1973 to Chamberlain, discloses an apparatus wherein a first fluid is fed longitudinally into a chamber and is converted into somewhat of a circumferential turbulent flow by vanes located in the chamber. A significant amount of the energy of the first fluid is lost by this arrangement.

SUMMARY OF THE INVENTION

The present invention avoids certain of the prior art problems noted above and provides an ejector which is a high pressure ratio, very compact ejector. The ejector of the present invention provides for extremely effective mixing of fluids and is quite simple in construction.

Specifically, in the present invention, a first or pumping fluid is formed into a generally tornado-like vortex advancing toward a smoothly curved relatively narrow throat. A second fluid inlet is positioned in the narrow throat. The vortex action creates a low pressure in the "eye" or center of the vortex, and the second fluid inlet extends axially of the vortex in the "eye". Action of the vortex pumps the second fluid through the second fluid inlet and thoroughly mixes same with the first fluid. The throat communicates with an outlet open to atmosphere through an outlet passage wherein the velocity of the mixed fluids is converted back to pressure.

In one arrangement, the vortex is created in a chamber having a shape generally in the form of a truncated cone, and which chamber includes a large end portion and a substantially smaller end portion having a throat communicating with an outlet. First fluid inlet means communicates with the chamber at the large end portion thereof and is positioned generally circumferentially or tangentially of the chamber in order to direct fluid tangentially into the chamber. When the first fluid is injected into the chamber at a high velocity through the first fluid inlet means, a generally tornado-like vortex is formed which advances toward the throat. Second fluid inlet means is located in the eye of the vortex which is at a very low pressure so that the second fluid is pumped into the chamber through the second fluid inlet means by the vortex action. The swirling flow of the first fluid thoroughly mixes the second fluid therewith.

In a preferred arrangement, the second fluid inlet means includes a conduit entering the chamber through the large end portion thereof concentric with the longitudinal axis of the chamber and having an open conduit and positioned adjacent or in the chamber throat. With this arrangement, the second fluid inlet means does not inhibit formation of the vortex or impede its progress in advancing toward the throat.

The throat communicates with an outlet open to atmosphere through a generally conical passage which expands outwardly of the throat. The velocity of the mixed fluids is converted back to pressure in the passage before discharge of the mixed fluids to atmosphere.

The improved mixing and pumping apparatus of the present invention provides a very compact, high pressure ratio ejector. The apparatus and method may be extremely advantageous in exhausting a chemical laser from 100 torr to 760 torr. However, it will be appreciated that the improved fluid mixing and pumping apparatus of the present invention may be used for pumping and mixing two fluids wherever such action is required or desirable. For example, the apparatus and method can be used with a sputtering chamber or the like wherein a plasma requires constant regeneration. In addition, the apparatus and method of the present invention may be used with liquid-liquid ejectors, known as jet pumps; gas-liquid ejectors, known as spray nozzles; or liquid-gas ejectors, known as aspirators.

BRIEF DESCRIPTION OF THE DRAWING

The drawing shows a cross-sectional schematic view of an apparatus embodying the present invention.

DESCRIPTION OF A PREFERRED EMBODIMENT

Referring now to the drawing, wherein the showings are for purposes of illustrating a preferred embodiment of the invention only and not for purposes of limiting same, a chamber A is generally in the shape of a truncated cone having a large end portion 12, and an opposite substantially smaller end portion generally in the form of a smoothly curved venturi-like throat 14. The chamber A includes a longitudinal axis 16 about which large end portion 12 and the throat 14 are concentric.

First fluid inlet means for a first or pumping fluid is generally indicated at 20 and extends generally circumferentially or tangentially of the chamber A. First fluid inlet means 20 may also be inclined slightly from left to right in the drawing, and may include more than one inlet so positioned.

A conduit 22 is connected with the first fluid inlet means 20 and a pump 24 or other first fluid source is provided for injection of a first fluid at a high velocity into the chamber A.

In the arrangement shown, the first fluid inlet means 20 is positioned at a radius of $r_1$ from the longitudinal axis 16, while the throat 14 has a substantially smaller radius $r_t$ from the longitudinal axis 16. A generally circumferential or conical outlet opening 26 is open to atmosphere and communicates with the throat 14 through a generally conical outwardly expanding passage 30. In the preferred arrangement, a member 32 is provided so that passage 30 extends generally conically, and throat 14 is not directly open to atmosphere. In other words, the passage 30 defines an outwardly expanding outlet passage having both outer surface 34 and inner surface 36. In a preferred arrangement, circumferential outlet 26, which is open to atmosphere, exhausts at a radius of $r_e$ greater than the radius $r_1$. This arrangement converts the velocity of the mixed fluids at the throat 14 back to pressure in the passage 30 prior to discharge thereof to atmosphere through the circumferential outlet 26.

When a first fluid is injected into the chamber A through the first fluid inlet means 20 at a high velocity, such as supersonic velocity, a generally tornado-like vortex is formed advancing from the large end portion 12 toward the smaller throat portion 14 which communicates with the outlet 26 through the passage 30. The vortex has an eye which is at a very low pressure and a second fluid inlet means is positioned in such eye. In one arrangement, the second fluid inlet means includes an elongated conduit 40 entering the chamber A through the large end portion 12 thereof substantially concentric with the longitudinal axis 16. The conduit 40 communicates with a source of a second fluid 42 and has an open end 44 positioned adjacent or in the throat 14 to define the second inlet means. In a preferred arrangement, the open conduit end 44 is located within the throat 14 for obtaining optimum pumping and mixing action. In general, the open conduit end 44 defines an outlet located within the chamber A for a second or pumped fluid, and such outlet is located adjacent or in the throat 14.

A first fluid is injected at a high velocity into the chamber A from a first fluid source or pump 24. The first fluid is injected generally circumferentially or tangentially of the chamber A so that a generally tornado-like vortex is formed advancing from the large end portion 12 toward the smaller end portion 14. The action of the vortex formed by the first fluid pumps a second fluid from the source 42 through the second fluid inlet means defined by the open end 44 of the conduit 40. When the second fluid is pumped axially into the chamber A, the swirling action of the tornado-like vortex formed by the first fluid thoroughly mixes with the second fluid. The mixed fluids then spiral out through the passage 30 in which the angular momentum of the two fluids is substantially reduced before they are finally exhaused through the outlet 26 which is open to atmosphere.

The first fluid is injected into the chamber A through the first fluid inlet means 20 at an angular velocity $V_1$ so that the angular momentum of the first fluid is $V_1r_1$. As the fluid spirals down to the throat 14, the angular momentum is conserved so that the velocity $V_t$ of the fluid at the throat 14 generally equals $V_1r_1/r_t$. Therefore, a very high mixing rate is achieved at the boundary of the pumped second fluid stream. The mixed fluids then spiral out through the passage 32 to the outlet 26 so that the rotational velocity or angular momentum is converted back to pressure.

In carrying out the improved method of the present application, a first or pumping fluid is formed into a generally tornado-like vortex having an eye. A second fluid inlet means located in the vortex eye has fluid pumped therethrough by action of the vortex. The two fluids are thoroughly mixed by the swirling action of the vortex, and the high velocity or angular momentum of the mixed fluids at the throat is converted back to pressure in an elongated passage extending from the throat to an outlet which is open to atmosphere. The outlet is preferably located at a radius greater than the inlet radius of the first fluid, although other arrangements are also possible where noise is not a problem. The outlet is preferably not simply an outwardly expanding larger opening but a generally conically-shaped outlet passage in which the velocity of the mixed fluids is converted back to pressure prior to discharge thereof to atmosphere.

In the arrangement shown and described, the chamber A generally in the shape of a truncated cone is coincidental or concentric about longitudinal axis 16, with the large end portion 12 and the throat 14 being concentric with the axis 16. The second fluid inlet means defined by the conduit 40 is also concentric with the longitudinal axis 16, and the open conduit end 44 is positioned adjacent or in the throat 14. Preferably, the open conduit end 44 is positioned within the throat 14 rather than inwardly or outwardly thereof relative to chamber A so that optimum pumping and mixing action is obtained. The throat 14 is smoothly curved as shown in the drawing between the chamber A and the outlet passage 30 in order that the advancing vortex gradually spirals down from the large end portion 12 toward the throat 14 and then gradually spirals outwardly through the passage 30 to the outlet 26. With this arrangement, a high mixing rate is obtained at the boundary of the pumped and pumping fluids. In addition, the rotational velocity of the mixed fluids is converted back to pressure in the outlet passage 30 prior to exhaust of the mixed fluids through the atmospheric outlet 26.

Obviously, it will be recognized that the chamber A may take other forms in order to form a generally tornado-like vortex from the first fluid. The chamber A may be described as funnel-like or having a shape like a truncated cone, but this does not mean that the walls of the chamber are straight or plane because they can be smoothly curved from the large end portion 12 toward the throat 14. The passage 30 has a terminal end defined by the outlet 26 communicating with atmosphere,, and the outlet 26 is located at a radius $r_e$ from the axis 16 which is preferably greater than the inlet radius $r_1$ for the first fluid inlet means 20.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

Having thus described my invention, I claim:

1. Apparatus for pumping a fluid at a pressure below ambient pressure, said apparatus comprising an enclosed fluid chamber having a funnel shaped first surface circumscribing a longitudinal axis and converging toward the longitudinal axis from a wide end to a narrow end, a throat comprising a second surface contiguous with said first surface and forming a venturi-like passage circumscribing said longitudinal axis and having a throat inlet disposed in fluid communication with said narrow end of said first surface, said second surface further forming a throat outlet, a diffuser having a diffuser inlet in fluid communication with the throat outlet of said venturi-like throat and a diffuser outlet at ambient pressure, means for introducing a pumping fluid tangentially into said chamber at the wide end thereof, said chamber and said throat configured to form the pumping fluid into a swirling vortex flow which advances toward said throat along a decreasing radius and at an increasing speed to form a low pressure region therein, low pressure fluid inlet means positioned on said longitudinal axis and in fluid communication with the low pressure region formed by the swirling vortex flow of pumping fluid so that the low pressure fluid is drawn through said low pressure fluid inlet and mixed with the pumping fluid to form a swirling flow of mixed fluid which advances through the venturi-like throat into the diffuser as a swirling flow, said diffuser comprising a first diverging surface contiguous with said second surface of said throat and a diffuser member disposed on said longitudinal axis in the path of the swirling fluid and including a second diverging surface facing and spaced apart from said first diverging surface and forming therewith a conical section for guiding a swirling flow of fluid from the outlet of the throat along a path of increasing radius to compress the mixed fluids to ambient pressure and blocking flow of ambient pressure through the diffuser to the throat.

2. A method of pumping a low pressure fluid at a pressure below ambient pressure including the steps of introducing a pumping fluid tangentially into the wide end of an enclosed funnel-shaped chamber which has a longitudinal axis and converges to a narrow end in fluid communication with a venturi-like throat, forming the pumping fluid into a swirling vortex flow which advances toward the narrow end of the chamber and into the venturi-like throat along a path of decreasing radius and at an increasing speed to form a low pressure region therein, which low pressure is lower than the pressure of the low pressure fluid, positioning a low pressure fluid inlet at the low pressure region of said chamber and located on the longitudinal axis thereof so that the low pressure fluid is drawn into the low pressure region in said swirling vortex flow of pumping fluid and mixed with the pumping fluid to form a swirling flow of mixed fluids which advances as a swirling flow through the venturi-like throat and enters a diffuser as a swirling flow of fluid, guiding the swirling flow in the diffuser along a conical path of increasing radius while resisting flow of ambient pressure through the diffuser to the venturi-like throat to compress the mixed fluids to ambient pressure.

* * * * *